US005585230A

United States Patent [19]

Zengerle et al.

[11] Patent Number: 5,585,230

[45] Date of Patent: Dec. 17, 1996

[54] CYAN COUPLER DISPERSION WITH IMPROVED STABILITY

[75] Inventors: Paul L. Zengerle; Allan F. Sowinski; Ronda E. Factor, all of Rochester, N.Y.

[73] Assignee: Eastman Kodak Company, Rochester, N.Y.

[21] Appl. No.: 409,368

[22] Filed: Mar. 23, 1995

[51] Int. Cl.[6] ..... G03C 7/34; G03C 7/388

[52] U.S. Cl. ..... 430/546; 430/552; 430/553; 430/631

[58] Field of Search ..... 430/546, 552, 430/553, 642, 631, 449, 493

[56] References Cited

U.S. PATENT DOCUMENTS

| | | | |
|---|---|---|---|
| 2,801,170 | 7/1957 | Vittum et al. | 430/546 |
| 2,801,171 | 7/1957 | Fierke et al. | 430/546 |
| 3,619,195 | 11/1971 | Van Campen | 430/554 |
| 3,880,661 | 4/1975 | Lau et al. | 430/553 |
| 4,080,209 | 3/1978 | Mukunoki et al. | 96/76 R |
| 4,146,399 | 3/1979 | Trunley et al. | 430/546 |
| 4,205,990 | 6/1980 | Deguchi et al. | 430/472 |
| 4,304,844 | 12/1981 | Fujimatsu et al. | 430/553 |
| 4,333,999 | 6/1982 | Lau | 430/17 |
| 4,474,872 | 10/1984 | Onishi et al. | 430/546 |
| 4,609,619 | 9/1986 | Katoh et al. | 430/553 |
| 4,885,234 | 12/1989 | Zengerle | 430/546 |
| 5,015,564 | 5/1991 | Chari | 430/546 |
| 5,112,729 | 5/1992 | Mihayashi | 430/546 |
| 5,173,398 | 12/1992 | Fukazawa et al. | 430/546 |
| 5,300,419 | 4/1994 | Seto et al. | 430/553 |
| 5,356,768 | 10/1994 | Bertramini et al. | 430/546 |
| 5,370,978 | 12/1994 | Takahashi | 430/505 |

FOREIGN PATENT DOCUMENTS

| | | | |
|---|---|---|---|
| 0097042 | 12/1983 | European Pat. Off. . | |
| 0102839B1 | 3/1984 | European Pat. Off. . | |
| 289820A1 | 11/1988 | European Pat. Off. . | |
| 0361924B1 | 4/1990 | European Pat. Off. . | |
| 0389817A1 | 10/1990 | European Pat. Off. . | |
| 0434028 | 6/1991 | European Pat. Off. . | |
| 553964A1 | 8/1993 | European Pat. Off. . | |
| 570973A1 | 11/1993 | European Pat. Off. . | |
| 0144129 | 9/1980 | Germany | 430/546 |
| 3624777A1 | 1/1988 | Germany . | |
| 3700570A1 | 7/1988 | Germany . | |
| 3936300A1 | 5/1991 | Germany . | |
| 3201647 | 8/1988 | Japan | 430/631 |
| 820329 | 9/1959 | United Kingdom . | |
| 93/03420 | 2/1993 | WIPO . | |

*Primary Examiner*—Lee C. Wright
*Attorney, Agent, or Firm*—Andrew J. Anderson

[57] ABSTRACT

Dispersions comprising particles of a phenolic cyan photographic coupler of Formula I dispersed in an aqueous gelatin solution substantially free of permanent organic solvent demonstrate improved stability to dispersion crystallization.

Formula I $R_1$ and $R_2$ in Formula I each represent an aliphatic group, an aromatic group, or a heterocyclic group. $R_3$ represents a hydrogen atom, a halogen atom, an aliphatic group, an aromatic group, an acylamino group, or a non-metallic atomic group necessary to form a nitrogen-containing 5-membered or 6-membered ring together with $R_2$. X represents a hydrogen atom or a group capable of being released upon a coupling reaction with oxidation product of a developing agent, and n represents 0 or 1.

18 Claims, 1 Drawing Sheet

CYAN COUPLER DISPERSION WITH IMPROVED STABILITY

FIELD OF THE INVENTION

This invention relates to dispersions of phenolic cyan dye-forming photographic couplers prepared without any permanent organic coupler solvent.

BACKGROUND OF THE INVENTION

In the design of silver halide light-sensitive multilayer photographic materials, it is desirable to minimize the dry thickness of the coated layers. Layer thinning is advantageous for reasons such as improved image sharpness due to reduced light scattering during exposure and increased developability due to shorter diffusion paths through the multilayer structure. This increase in developability can lead to lower silver and/or coupler coated levels, hence lower materials cost.

Photographic dye-forming couplers, as well as other hydrophobic photographically useful compounds, are generally incorporated into a layer of a photographic element by first forming an aqueous dispersion of the couplers and then mixing such dispersion with the layer coating solution. An organic solvent is generally used to dissolve the coupler, and the resulting organic solution is then dispersed in an aqueous medium to form the aqueous dispersion.

The organic phase of these dispersions frequently includes high-boiling or permanent organic solvents. Permanent high boiling solvents have a boiling point sufficiently high, generally above 150° C. at atmospheric pressure, such that they are not evaporated under normal dispersion making and photographic layer coating procedures. Permanent high-boiling coupler solvents are primarily used in the conventional "oil-protection" dispersion method whereby the organic solvent remains in the dispersion, and thereby is incorporated into the emulsion layer coating solution and ultimately into the photographic element.

In order to reduce the coated thickness of photographic layers, it is essential to minimize the amount of permanent coupler solvent coated in the element. In fact, reductions in coupler solvent level also afford concomitant reductions in gelatin level which leads to further reductions in coated dry thickness. U.S. Pat. No. 5,173,398, e.g., discloses photographic elements with coupler-containing layers having substantially no high-boiling solvent, wherein the couplers are incorporated in the layer in the form of precipitated dispersions. However, coupler solvent reduction can also result in excessive crystallization of the dispersed organic compounds in an aqueous dispersion or coating solution with photographic compounds that have a tendency to crystallize. These crystallization problems can cause filter-plugging during the manufacture of photographic materials or may result in physical defects in the coated product. Another difficulty with coupler solvent reduction is that the reactivity of the dispersed photographically useful chemical, such as a dye-forming coupler, may be too low to produce adequate dye density upon processing the photographic material.

Dispersions of photographic couplers made without using permanent coupler solvent are well-known in the art. Such dispersions are generally made with auxiliary solvents which are removed from the dispersion prior to coating. Auxiliary solvents may be water immiscible, volatile solvents, or solvents with limited water solubility which are not completely water miscible. In fact, there are many photographic compounds which can be dispersed with or without permanent solvent with no crystallization problems, as noted in U.S. Pat. No. 2,801,170. However, when the dispersed photographic compound is prone to crystallization, the tendency to crystallize generally becomes greater as the amount of coupler solvent, relative to coupler, is decreased, as noted in U.S. Pat. No. 5,112,729.

Phenolic cyan dye forming couplers are well-known in the art, and are known to be very prone to crystallization. Due to their crystalline nature, these couplers are often dispersed as mixtures of two or more couplers to avoid crystallization problems, as described in U.S. Pat. No. 4,885,234 and EP 434,028. However, use of these methods requires the synthesis of an additional photographic coupler which results in an increase in manufacturing cost. It is also well-known, as mentioned in U.S. Pat. No. 2,801,170, that coupler solvent reduction can result in reduced coupler reactivity. This reference also teaches the concept of combining a solvent-free coupler dispersion with a dispersion of a high boiling coupler solvent alone to produce satisfactory dye density. In order to achieve adequate coupler reactivity phenolic cyan dye-forming couplers are commonly dispersed with high-boiling organic solvents as described in U.S. Pat. No. 4,333,999, U.S. Pat. No. 4,609,619, EP 097,042, EP 102,839, EP 389,817, DE 3,624,777, DE 3,700,570, and DE 3,936,300.

U.S. Pat. No. 5,112,729 describes a photographic material containing a cyan naptholic coupler and a high-boiling solvent present in a weight ratio with respect to the coupler in the layer of not more than 0.3. Methods of increasing the dye yield of oil-free cyan coupler dispersions are disclosed in Research Disclosure 14532 (May, 1976). The specific cyan couplers described in these references fall outside the scope of the present invention. Crystallization of phenolic cyan couplers is also discussed in EP 361,924.

It would be desirable to provide a coupler dispersion which contains no permanent solvent which exhibits good stability toward crystallization and provides adequate coupler reactivity when coated in a silver halide light-sensitive photographic material.

SUMMARY OF THE INVENTION

An object of the present invention is to provide a dispersion of a phenolic cyan coupler with improved stability to dispersion crystallization following extended cold storage.

A further object of the present invention is to provide a coating solution for a silver halide photographic light-sensitive material containing a phenolic cyan coupler dispersion which exhibits improved stability to crystallization upon extended melt hold time.

Another object of the present invention is to provide a silver halide photographic light-sensitive material with reduced coated dry thickness.

It has now been found that the objects of the present invention are attained through use of a dispersion comprising particles of a phenolic cyan photographic coupler of Formula I dispersed in an aqueous gelatin solution substantially free of permanent organic solvent.

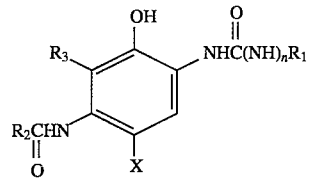

Formula I $R_1$ and $R_2$ in Formula I each represent an aliphatic group, an aromatic group, or a heterocyclic group. $R_3$ represents a hydrogen atom, a halogen atom, an aliphatic group, an aromatic group, an acylamino group, or a non-metallic atomic group necessary to form a nitrogen-containing 5-membered or 6-membered ring together with $R_2$. X represents a hydrogen atom or a coupling off group capable of being released upon a coupling reaction with oxidation product of a developing agent, and n represents 0 or 1.

The dispersions of the invention are preferably formed by dissolving a coupler of Formula I in an auxiliary solvent, dispersing the auxiliary solvent and dissolved coupler in an aqueous gelatin solution, and removing the auxiliary solvent from the dispersion.

The dispersions of the invention can be used to provide a silver halide color photographic light sensitive material by performing the steps of a) dispersing a coupler of Formula I in an aqueous gelatin solution substantially free of permanent organic solvent; b) preparing an aqueous coating solution comprising the dispersion resulting from a); and c) coating the solution resulting from b) on a photographic support.

Advantages

The present invention provides reduced dispersion crystallization for substantially permanent solvent-free dispersions of a specific class of cyan couplers. The improved stability is observed with single couplers as opposed to requiring the use of mixtures of more than one coupler. In the present invention, dispersions can be prepared at much higher concentrations without the use of a steric stabilizer which are generally required for precipitation dispersion techniques. In addition, the present invention is not restricted by the type of emulsion it can be used with.

DETAILED DESCRIPTION OF THE INVENTION

Figure 1:
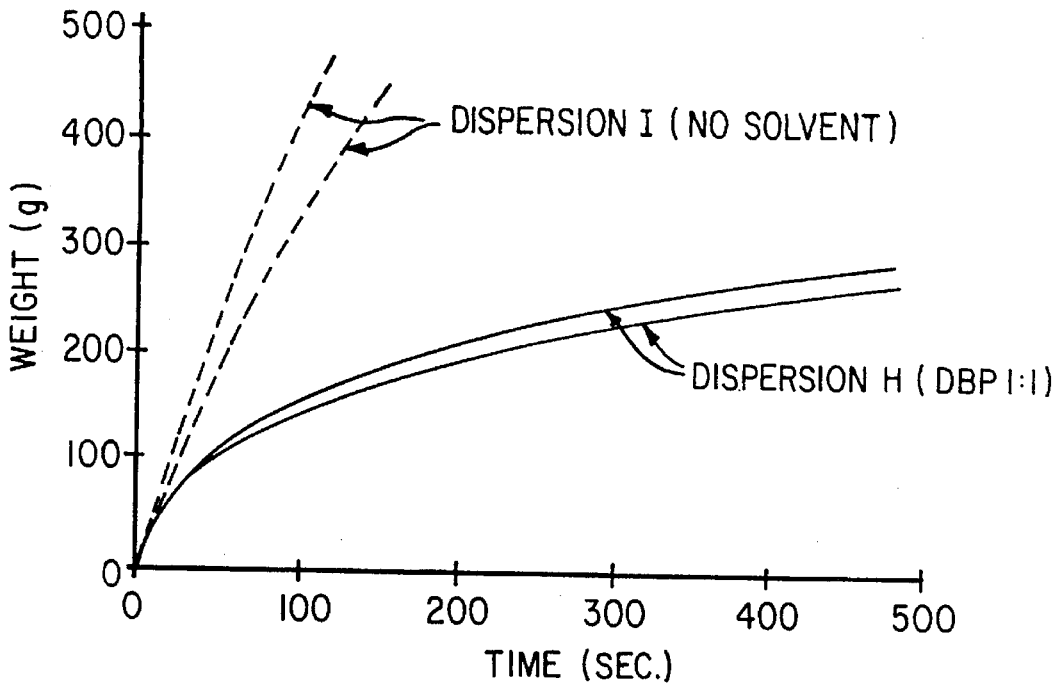
FIG. 1 is a graph depicting the filterability results of Dispersions I and H as described in Example 2.

In the cyan coupler represented by Formula I, $R_1$ and $R_2$ each represents an aliphatic group (preferably an aliphatic group having from 1 to 32 carbon atoms, e.g., methyl, butyl, dodecyl, cyclohexylallyl), an aryl group (e.g., phenyl, naphthyl) or a heterocyclic group (e.g., 2-pyridyl, 2-imidazolyl, 2-furyl, 6-quinolyl). It is understood throughout this specification that any reference to a substituent by the identification of a group containing a substitutable hydrogen, unless otherwise specifically stated, shall encompass not only the substituent's unsubstituted form, but also its form substituted with any other photographically useful substituents. For example, each such substitutable group can be substituted with one or more photographically acceptable substituents, such as those selected from an alkyl group, an aryl group, a heterocyclic group, an alkoxy group (e.g., methoxy, 2-methoxyethoxy), an aryloxy group (e.g., 2,4-ditert-amyl phenoxy, 2-chlorophenoxy, 4-cyanophenoxy), an alkenyloxy group (e.g., 2-propenyloxy), an acyl group (e.g., acetyl, benzoyl), an ester group (e.g., butoxycarbonyl, phenoxycarbonyl, acetoxy, benzoyloxy, butoxysulfonyl, toluenesulfonyloxy), an amido group (e.g., acetylamino, methanesulfonamido, dipropylsulfamoylamino), a carbamoyl group (e.g., dimethylcarbamoyl, ethylcarbamoyl), a sulfamoyl group (e.g., butylsulfamoyl), an imido group (e.g., succinimido, hydantoinyl), a ureido group (e.g., phenylureido, dimethylureido), an aliphatic or aromatic sulfonyl group (e.g., methanesulfonyl, phenylsulfonyl), an aliphatic or aromatic thio group (e.g., ethylthio, phenylthio), a hydroxy group, a cyano group, a carboxy group, a nitro group, a sulfo group, and a halogen atom. Usually the substituent will have less than 30 carbon atoms and typically less than 20 carbon atoms.

$R_3$ represents a hydrogen atom, a halogen atom, an aliphatic group, an aromatic group, an acylamino group, or a non-metallic atomic group necessary to form a nitrogen-containing 5-membered or 6-membered ring together with $R_2$. When $R_3$ in Formula I represents a substituent which can be substituted per se, it may be further substituted with one or more substituents selected from those as described for $R_1$ and $R_2$ above.

In Formula I, X represents a hydrogen atom or a coupling off group capable of being released upon coupling. Examples of the groups capable of being released upon coupling include a halogen atom (e.g., fluorine, chlorine, bromine), an alkoxy group (e.g., ethoxy, dodecyloxy, methoxycarbamoylmethoxy, carboxypropyloxy, methylsulfonylethoxy) an aryloxy group (e.g., 4-chlorophenoxy, 4-methoxyphenoxy, 4-carboxyphenoxy), an acyloxy group (e.g., acetoxy, tetradecanoyloxy, benzoyloxy), a sulfonyloxy group (e.g., methanesulfonyloxy, toluenesulfonyloxy), an amido group (e.g., dichloroacetylamino, heptafluorobutyrylamino, methanesulfonylamino, toluenesulfonylamino), an alkoxy carbonyloxy group (e.g., ethoxycarbonyloxy, benzyloxycarbonyloxy), an aryloxycarbonyloxy group (e.g., phenoxycarbonyloxy), an aliphatic or aromatic thio group (e.g., ethylthio, phenylthio, tetrazolythio, mercaptopropionic acid), an imido group (e.g., succinimido, hydantoinyl), a sulfonamido group and an aromatic azo group (e.g., phenylazo). These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006,755A and 2,017,704A, the disclosures of which are incorporated herein by reference. These groups may contain a photographically useful group.

In Formula I, $R_1$ is preferably an aryl group or a heterocyclic group. More preferred is an aryl group substituted with one or more substituents selected from a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group and a cyano group. Most preferred is an aryl group substituted with one or more halogen or cyano substituents.

In Formula I, when $R_3$ and $R_2$ do not combine with each other form a ring, $R_2$ is preferably an alkyl group or an aryl group, more preferably an alkyl group substituted with an aryloxy group, and $R_3$ is preferably a hydrogen atom.

In Formula I, X is preferably a hydrogen atom, a halogen atom, an alkoxy group, an aryloxy group, an acyloxy group or a sulfonamido group.

In a preferred embodiment of the invention, n is 1, and X is hydrogen atom, a halogen atom, or an aryloxy group in Formula I.

Preferred examples of the cyan couplers represented by Formula I according to the present invention will now be set forth below, but the present invention should not be construed as being limited thereto.

C-1
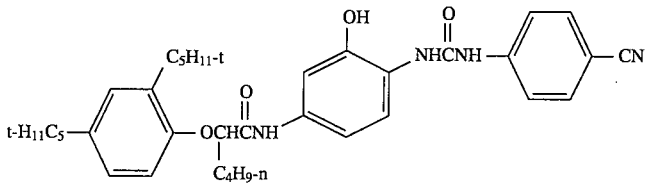
C-2
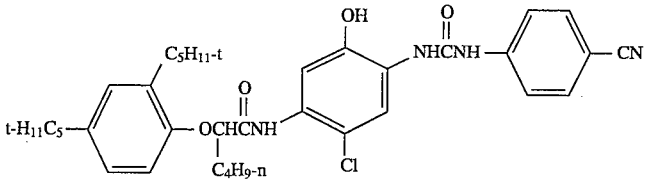
C-3
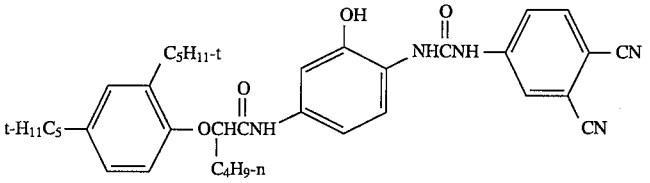
C-4
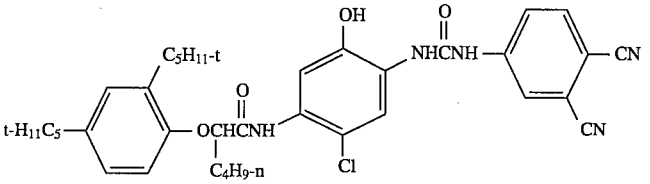
C-5
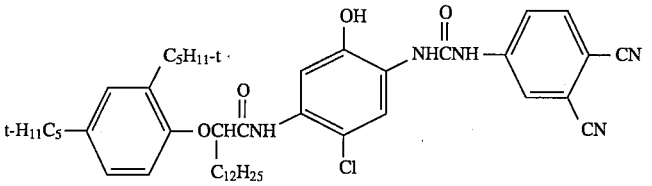
C-6
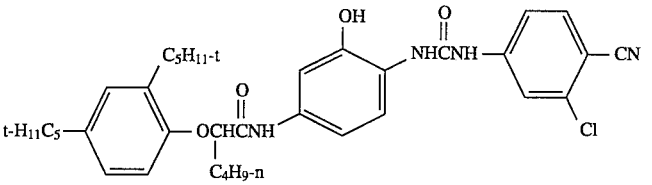
C-7
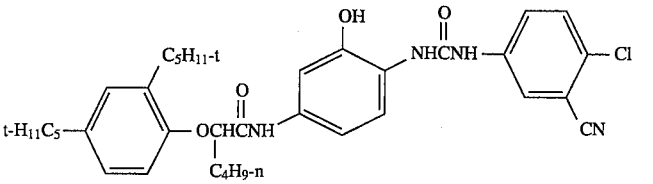
C-8
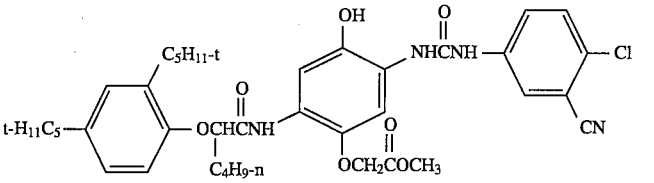

-continued

C-9

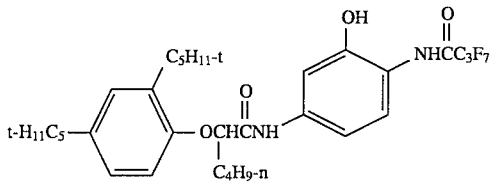

C-10

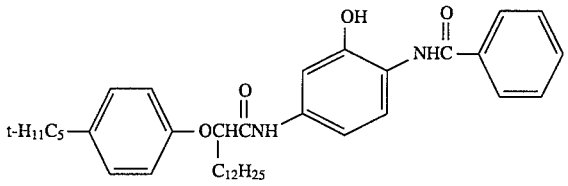

C-11

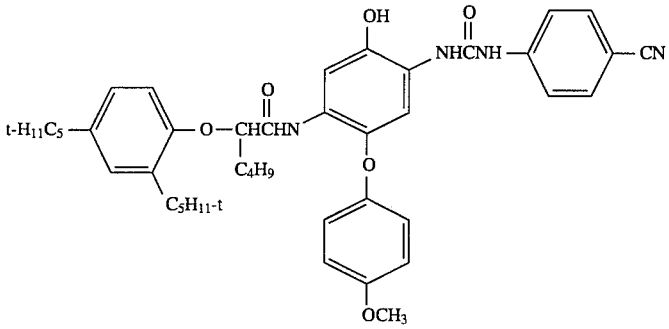

C-12

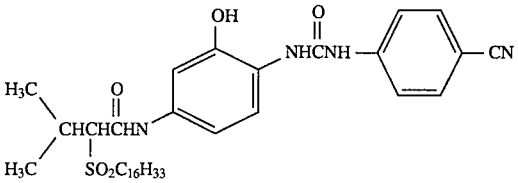

C-13

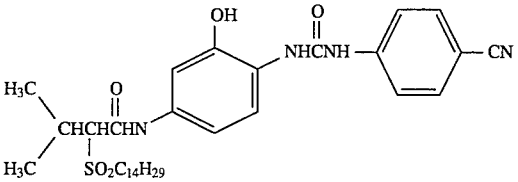

C-14

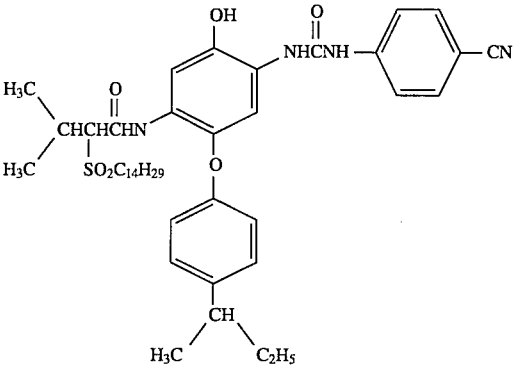

The substantially permanent solvent-free dispersions of the cyan couplers of formula I can be prepared by dissolving the couplers in a low-boiling or partially water-soluble organic auxiliary solvent, then mixing the resulting organic solution with an aqueous gelatin solution. The mixture is then passed through a mechanical mixing device suitable for high-shear or turbulent mixing generally suitable for preparing photographic emulsified dispersions, such as a colloid mill, homogenizer, microfluidizer, high speed mixer, ultrasonic dispersing apparatus, blade mixer, device in which a liquid stream is pumped at high pressure through an orifice or interaction chamber, Gaulin mill, blender, etc., to form small particles of the organic phase suspended in the aqueous phase. More than one type of device may be used to prepare the dispersions. The organic solvent is then removed by evaporation, noodle washing, or membrane dialysis. The dispersion particles preferably have an average particle size of less than 2 microns, generally from about 0.02 to 2 microns, more preferably from about 0.02 to 0.5 micron. These methods are described in detail in U.S. Pat. Nos. 2,322,027, 2,787,544, 2,801,180, 2,801,171, 2,949,360, and 3,396,027, the disclosures of which are incorporated by reference herein. For the purposes of this invention, "substantially free of permanent organic solvent", "no-solvent", and like terms are intended to denote the absence of permanent solvents beyond trace or impurity levels.

A surfactant may be present in either the aqueous phase or the organic phase or the dispersion can be prepared without any surfactant present. Surfactants may be cationic, anionic, zwitterionic or non-ionic. Ratios of surfactant to liquid organic solution typically are in the range of 0.5 to 25 wt. % for forming small particle photographic dispersions. In a preferred embodiment of the invention, an anionic surfactant is contained in the aqueous gelatin solution. Particularly preferred surfactants which are employed in the present invention include an alkali metal salt of an alkarylene sulfonic acid, such as the sodium salt of dodecyl benzene sulfonic acid, the sodium salt of isopropylnaphthalene sulfonic acid or a mixture of monomers, dimers, trimers and tetramers of the sodium salt of isopropylnaphthalene sulfonic acid; an alkali metal salt of an alkyl sulfuric acid, such as sodium dodecyl sulfate; or an alkali metal salt of an alkyl sulfosuccinate, such as sodium bis (2-ethylhexyl) succinic sulfonate.

Examples of suitable auxiliary solvents which can be used in the present invention include: ethyl acetate, isopropyl acetate, butyl acetate, ethyl propionate, 2-ethoxyethylacetate, 2-(2-butoxyethoxy) ethyl acetate, dimethylformamide, 2-methyl tetrahydrofuran, triethylphosphate, cyclohexanone, butoxyethyl acetate, methyl isobutyl ketone, methyl acetate, 4-methyl-2-pentanol, diethyl carbitol, 1,1,2-trichloroethane, 1,2-dichloropropane, and the like, Preferred auxiliary solvents included ethyl acetate and 2-(2-butoxyethyoxy) ethyl acetate.

The dispersions of the invention may contain more than one cyan coupler of Formula I, although it is not necessary that more than one coupler be employed to obtain the advantages of the invention. Preferred embodiments of the invention comprise dispersions of a single cyan coupler of Formula I substantially free of other cyan dye forming couplers. By "substantially free" is meant the absence of other cyan dye forming couplers beyond trace or impurity levels.

The aqueous phase of the dispersions of the invention comprise gelatin as a hydrophilic colloid. This may be gelatin or a modified gelatin such as acetylated gelatin, phthalated gelatin, oxidized gelatin, etc. Gelatin may be base-processed, such as lime-processed gelatin, or may be acid-processed, such as acid processed ossein gelatin. Other hydrophilic colloids may also be used, such as a water-soluble polymer or copolymer including, but not limited to poly(vinyl alcohol), partially hydrolyzed poly(vinylacetate-co-vinylalcohol), hydroxyethyl cellulose, poly(acrylic acid), poly(1-vinylpyrrolidone), poly(sodium styrene sulfonate), poly(2-acrylamido-2-methane sulfonic acid), polyacrylamide. Copolymers of these polymers with hydrophobic monomers may also be used.

The photographic elements comprising the dispersions of the invention can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, antihalation layers, overcoat layers, subbing layers, and the like.

If desired, the photographic element can be used in conjunction with an applied magnetic layer as described in *Research Disclosure*, November 1992, Item 34390. It is also specifically contemplated to use dispersions according to the invention in combination with technology useful in small format film as described in *Research Disclosure*, June 1994, Item 36230. *Research Disclosure* is published by Kenneth Mason Publications, Ltd., Dudley House, 12 North Street, Emsworth, Hampshire P010 7DQ, ENGLAND.

In the following discussion of suitable materials for use in the emulsions and elements that can be used in conjunction with this photographic element, reference will be made to *Research Disclosure*, September 1994, Item 36544, available as described above, which will be identified hereafter by the term "*Research Disclosure*." The contents of the *Research Disclosure*, including the patents and publications referenced therein, are incorporated herein by reference, and the Sections hereafter referred to are Sections of the *Research Disclosure*, Item 36544.

The silver halide emulsions employed in these photographic elements can be either negative-working or positive-working. Suitable emulsions and their preparation as well as methods of chemical and spectral sensitization are described in Sections I, and III–IV. Vehicles and vehicle related addenda are described in Section II. Dye image formers and modifiers are described in Section X. Various additives such as UV dyes, brighteners, luminescent dyes, antifoggants, stabilizers, light absorbing and scattering materials, coating aids, plasticizers, lubricants, antistats and matting agents are described , for example, in Sections VI–IX. Layers and layer arrangements, color negative and color positive features, scan facilitating features, supports, exposure and processing can be found in Sections XI–XX.

In addition to the cyan couplers of Formula I included in the dispersions of the invention, other photographic couplers may also be included in elements of the invention. Couplers that form cyan dyes upon reaction with oxidized color developing agents are described in such representative patents and publications as: U.S. Patent Nos. 2,367,531; 2,423,730; 2,474,293; 2,772,162; 2,895,826; 3,002,836; 3,034,892; 3,041,236; 4,333,999; 4,883,746 and "Farbkuppler—Eine Literature Ubersicht," published in Agfa Mitteilungen, Band III, pp. 156–175 (1961). Preferably such couplers are phenols and naphthols that form cyan dyes on reaction with oxidized color developing agent. Also preferable are the cyan couplers described in, for instance, European Patent Application Nos. 544,322; 556,700; 556,777; 565,096; 570,006; and 574,948. Especially preferred embodiments of the inveniton include the use of a cyan coupler of Formula I as the principle cyan dye forming image coupler.

Couplers that form magenta dyes upon reaction with oxidized color developing agent which can be incorporated in elements of the invention are described in such representative patents and publications as: U.S. Pat. Nos. 2,600,788; 2,369,489; 2,343,703; 2,311,082; 2,908,573; 3,062,653; 3,152,896; 3,519,429 and "Farbkuppler—Eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents. Preferred couplers include 1H-pyrazolo [5,1-c]-1,2,4-triazoles and 1H-pyrazolo [1,5-b]-1,2,4-triazoles. Examples of 1H-pyrazolo [5,1-c]-1,2,4-triazole couplers are described in U.K. Patent Nos. 1,247,493; 1,252,418; 1,398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo [1,5-b]-1,2,4-triazoles can be found in European Patent applications 176,804; 177,765; U.S. Pat. Nos. 4,659,652; 5,066,575; and 5,250,400. Especially preferred are pyrazolone couplers, such as described in U.S. Pat. No. 4,853,319.

Couplers that form yellow dyes upon reaction with oxidized color developing agent and which are useful in elements of the invention are described in such representative patents and publications as: U.S. Pat. Nos. 2,875,057; 2,407,210; 3,265,506; 2,298,443; 3,048,194; 3,447,928; 4,022,620; 4,443,536 and "Farbkuppler—Eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. No. 5,238,803.

To control the migration of various components coated in a photographic layer, including couplers, it may be desirable to include a high molecular weight hydrophobe or "ballast" group in the component molecule. Representative ballast groups include substituted or unsubstituted alkyl or aryl groups containing 8 to 40 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido (also known as acylamino), carbamoyl, alkylsulfonyl, arysulfonyl, sulfonamido, and sulfamoyl groups wherein the substituents typically contain 1 to 40 carbon atoms. Such substituents can also be further substituted. Alternatively, the molecule can be made immobile by attachment to polymeric backbone.

It may be useful to use a combination of couplers any of which may contain known ballasts or coupling-off groups such as those described in U.S. Pat. Nos. 4,301,235; 4,853,319 and 4,351,897.

It is also contemplated that the materials and processes described in an article titled "Typical and Preferred Color Paper, Color Negative, and Color Reversal Photographic Elements and Processing," published in *Research Disclosure*, February 1995, Volume 370 may also be advantageously used with the no-solvent dispersions of the invention.

The invention materials may further be used in combination with a photographic element containing image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613. Such compounds are also disclosed in "Developer-Inhibitor-Releasing (DIR) Couplers for Color Photography," C. R. Barr, J. R. Thirtle and P. W. Vittum in *Photographic Science* and *Engineering*, Vol. 13, p. 174 (1969), incorporated herein by reference.

Especially useful for use with this invention are tabular grain silver halide emulsions. Suitable tabular grain emulsions can be selected from among a variety of conventional teachings , such as those of the following: Research Disclosure, Item 22534, January 1983; U.S. Pat. Nos. 4,439,520; 4,414,310; 4,433,048; 4,643,966; 4,647,528; 4,665,012; 4,672,027; 4,678,745; 4,693,964; 4,713,320; 4,722,886; 4,755,456; 4,775,617; 4,797,354; 4,801,522; 4,806,461; 4,835,095; 4,853,322; 4,914,014; 4,962,015; 4,985,350; 5,061,069; 5,061,616; and 5,320,938.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Specifically contemplated and preferred are Se and Ir doped tabular emulsions as described in U.S. Pat. No. 5,164,292. Usage of the invention in combination with thin layers as described in U.S. Pat. No. 5,322,766 is also specifically contemplated and preferred.

The emulsions can be spectrally sensitized with any of the dyes known to the photographic art, such as the polymethine dye class, which includes the cyanines, merocyanines, complex cyanines and merocyanines, oxonols, hemioxonols, styryls, merostyryls and streptocyanines. In particular, it would be advantageous to use the low staining sensitizing dyes disclosed in U.S. Pat. Nos. 5,316,904, 5,292,634, 5,354,651, and EP patent application 93/203193.3, in conjunction with elements of the invention.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

EXAMPLE 1

30 g of cyan coupler C-1 was dissolved in 30 g of di-n-butyl phthalate (DBP) and 60 g of ethyl acetate at 75° C. This oil phase solution was then combined with an aqueous phase solution consisting of 40 g gelatin, 32 g of a 10% solution of Alkanol-XC (Dupont), and 308 g of distilled water. This mixture was then passed through a Gaulin colloid mill five times followed by removal of ethyl acetate by rotary evaporation. Distilled water was then added back to form Dispersion A which consisted of 6% coupler, 8% gel. Dispersions B through G were similarly prepared with various levels of DBP as described in Table I. These dispersions were kept in cold storage for 26 weeks and were than held for 6 hours at 45° C. and then examined for crystallization by optical microscopy. Results are summarized in Table I below. Microscopic examination showed that only the dispersion containing no coupler solvent provided good resistance to crystal formation after extended cold storage followed by melt holding at elevated temperature.

When these dispersions were held at 45° C. for extended times, the coupler crystallization was so severe that the entire dispersion became a solid mass. The time required for this solidification to occur is another indicator of dispersion stability, and is also indicated in Table I. These results clearly show that the no solvent dispersion has markedly improved melt hold stability compared with the solvent-containing dispersions.

TABLE I

| Dispersion | Coupler | Solvent/ Coupler | Microscopic Apperance | Time to Solidify |
|---|---|---|---|---|
| A | C-1 | 1.00 | Many large and small crystals | 22 hr |
| B | C-1 | 0.50 | Severe crystallization | 18 hr |
| C | C-1 | 0.00 | Few small crystals | 123 hr |
| D | C-1 | 1.25 | Many large and small crystals | 33 hr |
| E | C-1 | 0.25 | Many large and small crystals | 21 hr |
| F | C-1 | 0.75 | Severe crystallization | 21 hr |
| G | C-1 | 1.00 | Many large and small crystals | 39 hr |

EXAMPLE 2

Dispersions H and I were prepared like Dispersions A and C, respectively (with and without DBP). These dispersions were then diluted 1:1 with 8% gelatin to form coating solutions consisting of 3% coupler and 8% gel. 500 g of each coating solution was held for 24 hours at 45° C. and then passed through a Grade 24 glass-fiber depth filter (Hollingworth and Vose) under pressure (5 psi). The time required for the coating solution to pass through the filter is an indication of the stability of dispersion making up the coating solution. More stable dispersions filter through more rapidly than less stable dispersions. Filterability of the coating solution was evaluated by measuring the weight of coating solution passing through the filter as a function of time. The results for two repeated trials, illustrated in FIG. 1, show that the coating solutions containing the no-solvent cyan coupler dispersion passed through the filter much more rapidly than the solution with the solvent-containing dispersion.

EXAMPLE 3

30 g of cyan coupler C-12 was dissolved in 90 g of ethyl acetate at 70° C. This oil phase solution was then combined with an aqueous phase solution consisting of 30 g gelatin, 30 g of a 10% solution of Alkanol-XC (Dupont), and 320 g of distilled water. This mixture was then passed through a Gaulin colloid mill five times followed by removal of the ethyl acetate by rotary evaporation. Distilled water was then added back to form Dispersion J which consisted of 6% coupler, 6% gel. Dispersions K and L were similarly prepared with DBP present in the oil phase at the levels given in Table II. These dispersions were kept in cold storage for 1 week and were then held for 4 hours at 45° C. and were subsequently examined for crystallization by microscopy. These dispersions were also held at 45° C. for longer times to determine the time needed for solidification to occur. Results are summarized below:

TABLE II

| Dispersion | Coupler | Solvent/ Coupler | Microscopic Apperance | Time to Solidify |
|---|---|---|---|---|
| J | C-12 | 0.0 | No Crystallization | 10 hours |
| K | C-12 | 0.5 | Severe Crystallization | 4 hours |
| L | C-12 | 1.0 | Many, fine needle-shaped crystals | 7 hours |

The results also show that the no solvent dispersion has improved melt hold stability compared to the solvent-containing dispersions.

EXAMPLE 4

Figure 2:
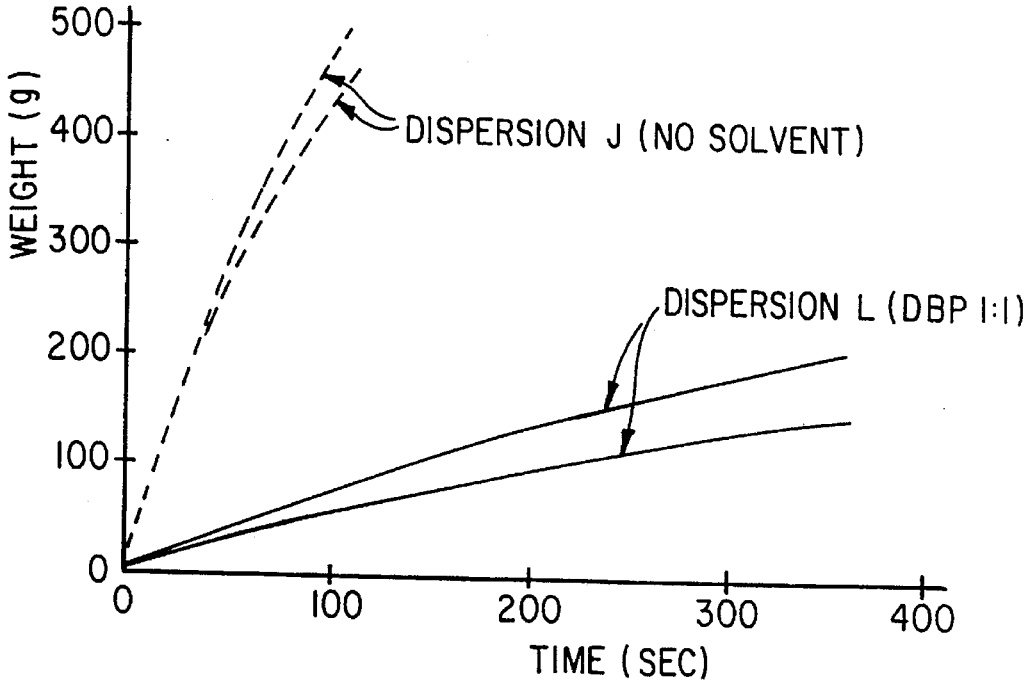
FIG. 2 is a graph depicting the filterability results of Dispersions J and L as described in Example 4.

Dispersions J and L were diluted 1:2 with 6% gelatin to form coating solutions consisting of 2% coupler and 6% gel. 500 g of each coating solution was held for 6 hours at 45° C. and then tested for filterability as described in Example 2. The results for two repeated trials, shown in FIG. 2, again demonstrate that the coating solution containing the no-solvent cyan coupler dispersion was more filterable than the solvent-containing dispersion.

EXAMPLE 5

Dispersions M, N, and O were prepared like Dispersions J, K, and L of Example 3, respectively, except that cyan coupler C-9 was substituted for cyan coupler C-12. These dispersions were kept in cold storage for 2 weeks and were then held for 40 hours at 45° C. and were subsequently examined for crystallization by microscopy. Results are summarized in Table III below:

TABLE III

| Dispersion | Coupler | Solvent/Coupler | Microscopic Appearance |
|---|---|---|---|
| M | C-9 | 0.0 | Few small crystals |
| N | C-9 | 0.5 | Severe crystallization |
| O | C-9 | 1.0 | No crystallization |

Again, the no solvent dispersion was considerably more stable than the low solvent dispersion of the prior art.

EXAMPLE 6

Dispersions AA through OO were prepared as described in Example 3 using the photographic comparison compounds, coupler solvents and incubation conditions described in Table IV. Results of microscopic evaluations are given below:

TABLE IV

| Dispersion | Compound | Solvent | Solvent/ Compound | Storage Time | Hold Time @ 45° C. | Microscopic Appearance |
|---|---|---|---|---|---|---|
| AA | Comp-1 | — | 0.0 | 2 weeks | 0 hours | Severe crystallization |
| BB | Comp-1 | DBP | 0.5 | 2 weeks | 0 hours | Very few small crystals |
| CC | Comp-1 | DBP | 1.0 | 2 weeks | 0 hours | No crystallization |
| DD | Comp-2 | — | 0.0 | 2 weeks | 0 hours | Severe crystallization |
| EE | Comp-2 | DBP | 0.5 | 2 weeks | 0 hours | No crystallization |
| FF | Comp-2 | DBP | 1.0 | 2 weeks | 0 hours | No crystallization |
| GG | Comp-3 | — | 0.0 | 2 weeks | 20 hours | Severe crystallization |
| HH | Comp-3 | DBP | 0.5 | 2 weeks | 20 hours | No crystallization |
| II | Comp-3 | DBP | 1.0 | 2 weeks | 20 hours | No crystallization |
| JJ | Comp-4 | — | 0.0 | 1 week | 24 hours | Many plate crystals |
| KK | Comp-4 | DBP | 0.5 | 1 week | 24 hours | Few plate crystals |
| LL | Comp-4 | DBP | 1.0 | 1 week | 24 hours | No crystallization |
| MM | Comp-5 | — | 0.0 | 1 week | 24 hours | Severe crystallization |
| NN | Comp-5 | TCP | 0.5 | 1 week | 24 hours | Severe small crystals |
| OO | Comp-5 | TCP | 1.0 | 1 week | 24 hours | Very few small crystals |

DBP = dibutylphthalate
TCP = tricresylphosphate

These results clearly demonstrate that dispersions containing no coupler solvent are substantially more crystal prone than their solvent-containing counterparts for a wide variety of photographically useful compounds that have a tendency to crystallize in dispersions.

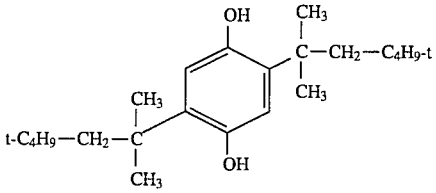

Comp-1

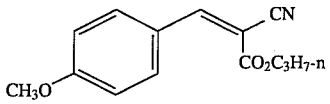

Comp-2

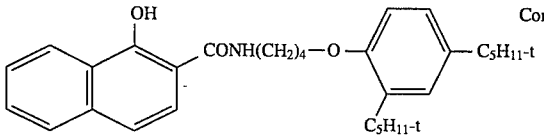

Comp-3

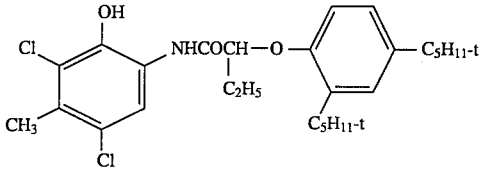

Comp-4

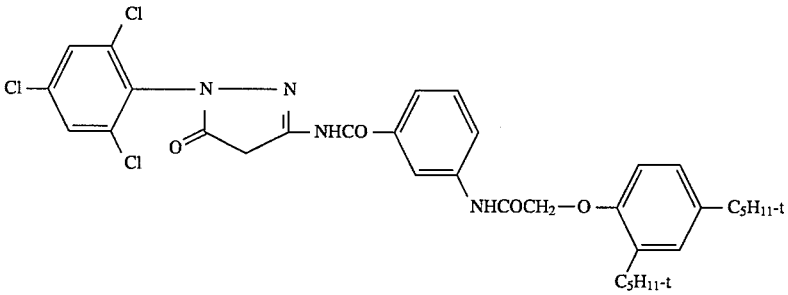

Comp-5

PHOTOGRAPHIC EXAMPLE 7

Sample 101 (comparative control)

A color photographic recording material for color negative development was prepared by applying the following layers in the given sequence to a support of cellulose triacetate. The side of the support to be coated had been prepared by gelatin subbing, and the reverse side of the support comprised dispersed carbon pigment in a non-gelatin binder (rem jet coating) that was soluble in basic aqueous solutions, and which served to provide a removable black antihalation backing with antistatic properties. The quantities of silver halide are given in g of silver/$m^2$. The quantities of other materials are given in g/$m^2$. The cyan dye-forming coupler C-1 employed in the low and high sensitivity red-sensitive layers was dispersed in the general manner of the comparative control dispersion A in dispersion Example 1, with a ratio of high boiling solvent di-n-butylphthalate to coupler of 1.0. The various compounds used in the photographic examples are identified following the examples.

Layer 1: Low Sensitivity Red-Sensitive Layer

This layer comprised a blend of a lower sensitivity, red-sensitized, silver iodobromide emulsion (3.0% iodide, 0.58 micrometers diameter) and a higher sensitivity, red-sensitized silver iodobromide emulsion (4.0% iodide, 0.86 micrometers diameter).

| | |
|---|---|
| Lower sensitivity emulsion | 1.356 |
| Higher sensitivity emulsion | 0.581 |
| DIR coupler D-1 | 0.031 |

-continued

| | |
|---|---|
| Bleach accelerator coupler BAR-1 | 0.021 |
| Cyan dye-forming coupler C-1 | 0.288 |
| HBS-1 | 0.124 |
| HBS-2 | 0.288 |
| HBS-3 | 0.021 |
| TAI | 0.031 |
| Gelatin | 2.523 |

Layer 2: High Sensitivity Red-Sensitive Layer

Red sensitized silver iodobromide emulsion [6.0 mol % iodide, average grain diameter 1.14 micrometers].

| | |
|---|---|
| Emulsion | 0.969 |
| DIR coupler D-2 | 0.076 |
| Cyan dye-forming magenta colored coupler CM-1 | 0.028 |
| Cyan dye-forming coupler C-1 | 0.093 |
| HBS-2 | 0.093 |
| HBS-4 | 0.150 |
| TAI | 0.016 |
| Gelatin | 1.388 |

Layer 3: Interlayer

| | |
|---|---|
| Compensatory printing density yellow dye MM-1 | 0.059 |
| Oxidized developer scavenger S-1 | 0.095 |
| Compensatory printing density magenta dye MD-1 | 0.024 |
| Gelatin | 0.947 |

Layer 4: Low Sensitivity Green-Sensitive Layer

This layer comprised a blend of lower sensitivity, green-sensitized silver iodobromide emulsion [3.0 mol % iodide, average grain diameter 0.44 micrometers] and higher sensitivity, green-sensitized silver iodobromide emulsion [6.0 mol % iodide, average grain diameter 0.77 micrometers].

| | |
|---|---|
| Lower sensitivity emulsion | 0.162 |
| Higher sensitivity emulsion | 1.185 |
| DIR coupler D-3 | 0.022 |
| Magenta dye-forming yellow colored coupler MM-2 | 0.135 |
| Magenta dye-forming coupler M-1 | 0.236 |
| Magenta dye-forming coupler M-2 | 0.101 |
| Oxidized developer scavenger S-2 | 0.015 |
| HBS-1 | 0.481 |
| TAI | 0.022 |
| Gelatin | 1.822 |

Layer 5: High Sensitivity Green-Sensitive Layer Green-sensitized silver iodobromide emulsion [3.0 mol % iodide, average grain diameter 0.81 micrometers].

| | |
|---|---|
| Emulsion | 0.861 |
| DIR coupler D-3 | 0.019 |
| Magenta dye-forming yellow colored coupler MM-2 | 0.027 |
| Magenta dye-forming coupler M-3 | 0.060 |
| Oxidized developer scavenger S-2 | 0.012 |
| HBS-1 | 0.152 |
| TAI | 0.014 |
| Gelatin | 1.250 |

Layer 6: Yellow Filter Layer

| | |
|---|---|
| Compensatory printing density yellow dye MM-1 | 0.091 |
| Yellow filter dye YD-1 | 0.154 |
| Oxidized developer scavenger S-1 | 0.118 |
| Gelatin | 0.947 |

Layer 7: Low Sensitivity Blue-Sensitive Layer

This layer comprised a blend of lower sensitivity, blue-sensitized silver iodobromide emulsion [3.0 mol % iodide, average grain diameter 0.56 micrometers] and higher sensitivity, blue-sensitized silver iodobromide emulsion [3.0 mol % iodide, average grain diameter 0.76 micrometers].

| | |
|---|---|
| Lower sensitivity emulsion | 0.182 |
| Higher sensitivity emulsion | 0.182 |
| DIR coupler D-10 | 0.009 |
| Yellow dye-forming coupler Y-1 | 0.725 |
| Oxidized developer scavenger S-2 | 0.010 |
| HBS-2 | 0.372 |
| TAI | 0.006 |
| Gelatin | 1.557 |

Layer 8: High Sensitivity Blue-Sensitive Layer

Blue-sensitized silver iodobromide emulsion [3.0 mol % iodide, average grain diameter 1.07 micrometers].

| | |
|---|---|
| Emulsion | 0.450 |
| DIR coupler D-4 | 0.039 |
| Yellow dye-forming coupler Y-1 | 0.133 |
| Oxidized developer scavenger S-2 | 0.019 |
| HBS-2 | 0.106 |
| TAI | 0.001 |
| Gelatin | 0.965 |

Layer 9: Ultraviolet Filter Layer

| | |
|---|---|
| Dye UV-1 | 0.022 |
| Dye UV-2 | 0.114 |
| Unsensitized silver bromide Lippmann emulsion | 0.215 |
| HBS-5 | 0.136 |
| Gelatin | 0.861 |

Layer 10: Protective Overcoat Layer

| | |
|---|---|
| Polymethylmethacrylate matte beads | 0.009 |
| Soluble polymethylmethacrylate matte beads | 0.161 |
| Silicone lubricant | 0.057 |
| Gelatin | 0.873 |

This film was hardened at coating with 1.80% by weight of total gelatin of hardener H-1. Surfactants, coating aids, soluble absorber dyes and stabilizers were added to the various layers of this sample as is commonly practiced in the art.

Sample 102 (invention)

A color photographic recording material for color negative development was prepared exactly as in Sample 101 above, except where noted below. The cyan dye-forming coupler C-1 employed in the low and high sensitivity red-sensitive layers was dispersed in the general manner of the inventive example C in dispersion Example 1, without the presence of a high boiling solvent.

Layer 1: Low Sensitivity Red-Sensitive Layer Changes

| | |
|---|---|
| Bleach accelerator coupler BAR-1 | 0.019 |
| Cyan dye-forming coupler C-1 | 0.262 |
| HBS-1 | 0.124 |
| HBS-2 | 0.000 |
| HBS-3 | 0.019 |
| Gelatin | 2.477 |

Layer 2: High Sensitivity Red-Sensitive Layer Changes

| | |
|---|---|
| Cyan dye-forming magenta colored coupler CM-1 | 0.031 |
| Cyan dye-forming coupler C-1 | 0.104 |
| HBS-2 | 0.000 |
| Gelatin | 1.431 |

Layer 4: Low Sensitivity Green-Sensitive Layer Changes

| | |
|---|---|
| Magenta dye-forming coupler M-1 | 0.198 |
| Magenta dye-forming coupler M-2 | 0.084 |
| HBS-1 | 0.453 |
| Gelatin | 1.781 |

Duplicate samples of photographic recording materials Sample 101 and 102 were individually exposed for 1/50 of a second to white light from a tungsten light source of 3200 K color temperature through a graduated 0–3.0 density step tablet to determine their speed and gamma. The samples were then processed using a color negative process, the KODAK ECN-2 process as described by the "Manual for Processing Eastman Motion Picture Film", Publication H-24.07, Eastman Kodak Company, Rochester, N.Y. This motion picture film color negative process and other color negative processes such as the color negative amateur film process C-41 are described in the British Journal of Photography Annual of 1988 at pages 196–198 (KODAK is a trademark of the Eastman Kodak Company, U.S.A.).

Following processing and drying, Samples 101 and 102 were subjected to Status M densitometry, and the duplicate sample density data were averaged. The photographic performance of the recording materials is compared below in Table V.

TABLE V

| Sample | D-min | ER Speed | Gamma | Density at 0.20 log H |
|---|---|---|---|---|
| 101 (control) | | | | |
| Red | 0.131 | 471 | 0.545 | 1.37 |
| Green | 0.554 | 473 | 0.625 | 1.93 |
| Blue | 0.957 | 483 | 0.654 | 2.45 |
| 102 (invention) | | | | |
| Red | 0.129 | 471 | 0.523 | 1.38 |
| Green | 0.,552 | 474 | 0.624 | 1.92 |
| Blue | 0.956 | 483 | 0.642 | 2.48 |

The photographic data show that the inventive high boiling solvent-free dispersion of cyan dye-forming coupler C-1 can result in essentially identical sensitometric performance following direct substitution for the comparative control dispersion employing di-n-butylphthalate in a weight ratio 1.0 to C-1 in the color negative recording material of Example 1.

PHOTOGRAPHIC EXAMPLE 8

Sample 201 (comparative control)

A color photographic recording material for color negative development was prepared by applying the following layers in the given sequence to a transparent support of cellulose triacetate. The side of the support to be coated had been prepared by gelatin subbing. The quantities of silver halide are given in g of silver/m$^2$. The quantities of other materials are given in g/m$^2$. The cyan dye-forming coupler C-1 employed in the low, medium and high sensitivity red-sensitive layers was dispersed in the general manner of the comparative control dispersion A in dispersion Example 1, with a ratio of high boiling solvent di-n-butylphthalate to coupler of 1.0.

Layer 1: Antihalation Layer

| Black colloidal silver sol (0.151 g/m$^2$). | |
|---|---|
| UV-1 | 0.075 |
| UV-2 | 0.075 |
| Oxidized developer scavenger S-3 | 0.162 |
| Compensatory printing density cyan dye CD-1 | 0.020 |
| Compensatory printing density magenta dye MD-2 | 0.042 |
| Compensatory printing density yellow dye MM-1 | 0.088 |
| Compensatory printing density yellow dye YD-2 | 0.008 |
| HBS-1 | 0.426 |
| HBS-5 | 0.151 |
| Disodium salt of 3,5-di-sulfocatechol | 0.270 |
| Gelatin | 2.441 |

Layer 2: Low Sensitivity Red-Sensitive Layer

This layer comprised a blend of a lower sensitivity, red-sensitized tabular silver iodobromide emulsion [1.3% iodide, average grain diameter 0.53 micrometers and thickness 0.09 micrometers thick] and a higher sensitivity, red-sensitized tabular silver iodobromide emulsion [4.1% iodide, average grain diameter 1.04 micrometers and thickness 0.09 micrometers].

| | |
|---|---|
| Lower sensitivity emulsion | 0.495 |
| Higher sensitivity emulsion | 0.431 |
| Bleach accelerator coupler BAR-1 | 0.038 |
| Cyan dye-formng coupler C-1 | 0.517 |
| Cyan dye-forming magenta colored coupler CM-1 | 0.027 |
| Oxidized developer scavenger S-2 | 0.010 |
| HBS-2 | 0.517 |
| HBS-3 | 0.038 |
| TAI | 0.015 |
| Gelatin | 1.775 |

Layer 3: Medium Sensitivity Red-Sensitive Layer

Red-sensitized tabular silver iodobromide emulsion [4.1 mol % iodide, average grain diameter 1.39 micrometers and thickness 0.12 micrometers].

| | |
|---|---|
| Emulsion | 0.700 |
| DIR coupler D-5 | 0.011 |
| Cyan dye-forming magenta colored coupler CM-1 | 0.022 |
| Cyan dye-forming coupler C-1 | 0.215 |
| HBS-2 | 0.215 |
| HBS-4 | 0.022 |
| TAI | 0.011 |
| Gelatin | 1.786 |

Layer 4: High Sensitivity Red-Sensitive Layer

Red-sensitized, tabular silver iodobromide emulsion [4.1 mol % iodide, average grain diameter 2.93 micrometers and thickness 0.13 micrometers].

| | |
|---|---|
| Emulsion | 1.076 |
| DIR coupler D-5 | 0.020 |
| DIR coupler D-6 | 0.048 |
| Cyan dye-forming magenta colored coupler CM-1 | 0.032 |
| Cyan dye-forming coupler C-1 | 0.140 |
| HBS-1 | 0.194 |
| HBS-2 | 0.140 |
| HBS-4 | 0.041 |
| TAI | 0.010 |
| Gelatin | 1.711 |

Layer 5: Interlayer

| | |
|---|---|
| Gelatin | 1.292 |

Layer 6: Low Sensitivity Green-Sensitive Layer

This layer comprised a blend of lower sensitivity, green-sensitized tabular silver iodobromide emulsion [1.3 mol % iodide, average grain diameter 0.53 micrometers and thickness 0.09 micrometers] and higher sensitivity, green-sensitized tabular silver iodobromide emulsion [4.1 mol % iodide, average grain diameter 1.04 micrometers and thickness 0.09 micrometers].

| | |
|---|---|
| Lower sensitivity emulsion | 0.581 |
| Higher sensitivity emulsion | 0.312 |
| Magenta dye-forming yellow colored coupler MM-2 | 0.065 |
| Magenta dye-forming coupler M-4 | 0.269 |
| Oxidized developer scavenger S-2 | 0.023 |
| HBS-1 | 0.345 |
| TAI | 0.014 |
| Gelatin | 1.723 |

Layer 7: Medium Sensitivity Green-Sensitive Layer

Green-sensitized tabular silver iodobromide emulsion [4.1 mol % iodide, average grain diameter 1.23 micrometers and thickness 0.12 micrometers].

| | |
|---|---|
| Emulsion | 0.969 |
| DIR coupler D-5 | 0.024 |
| Magenta dye-forming yellow colored coupler MM-2 | 0.065 |
| Magenta dye-forming coupler M-4 | 0.070 |
| Oxidized developer scavenger S-2 | 0.019 |
| HBS-1 | 0.186 |
| HBS-4 | 0.048 |
| TAI | 0.014 |
| Gelatin | 1.399 |

Layer 8: High Sensitivity Green-Sensitive Layer

Green-sensitized, tabular silver iodobromide emulsion [4.1 mol % iodide, average grain diameter 2.19 micrometers and thickness 0.13 micrometers].

| | |
|---|---|
| Emulsion | 0.969 |
| DIR coupler D-3 | 0.011 |
| DIR coupler D-7 | 0.011 |
| Magenta dye-forming yellow colored coupler MM-2 | 0.054 |
| Magenta dye-forming coupler M-4 | 0.058 |
| Oxidized developer scavenger S-2 | 0.016 |
| HBS-1 | 0.176 |
| HBS-2 | 0.011 |
| TAI | 0.012 |
| Gelatin | 1.291 |

Layer 9: Yellow Filter Layer

| | |
|---|---|
| Yellow filter dye YD-1 | 0.108 |
| Gelatin | 1.292 |

Layer 10: Low Sensitivity Blue-Sensitive Layer

This layer comprised a blend of lower sensitivity, blue-sensitized tabular silver iodobromide emulsion [1.3 mol % iodide, average grain diameter 0.53 micrometers and thickness 0.09 micrometers], medium sensitivity, tabular blue-sensitized silver iodobromide emulsion [4.1 mol % iodide, average grain diameter 0.80 micrometers and thickness 0.09 micrometers] and higher sensitivity, tabular blue-sensitized silver iodobromide emulsion [6.0 mol % iodide, average grain diameter 0.96 micrometers and thickness 0.26 micrometers].

| | |
|---|---|
| Lower sensitivity emulsion | 0.269 |
| Medium sensitivity emulsion | 0.172 |
| Higher sensitivity emulsion | 0.549 |
| DIR coupler D-8 | 0.065 |
| Yellow dye-forming coupler Y-1 | 0.280 |
| Yellow dye-forming coupler Y-2 | 0.700 |
| Bleach accelerator coupler BAR-1 | 0.003 |
| Cyan dye-forming coupler C-1 | 0.027 |
| Oxidized developer scavenger S-2 | 0.005 |
| HBS-2 | 0.931 |
| HBS-3 | 0.003 |
| TAI | 0.016 |
| Gelatin | 2.519 |

Layer 11: High Sensitivity Blue-Sensitive Layer

This layer comprised a blend of lower sensitivity, blue-sensitized silver iodobromide emulsion [9.0 mol % iodide, average grain diameter 1.06 micrometers] and high sensitivity, tabular blue-sensitized silver iodobromide emulsion [4.1 mol % iodide, average grain diameter 3.37 micrometers and thickness 0.14 micrometers]

| | |
|---|---|
| Low sensitivity emulsion | 0.226 |
| High sensitivity emulsion | 0.570 |
| Yellow dye-forming coupler Y-1 | 0.080 |
| Yellow dye-forming coupler Y-2 | 0.200 |
| DIR coupler D-8 | 0.048 |
| Bleach accelerator coupler BAR-1 | 0.005 |
| Cyan dye-forming coupler C-1 | 0.029 |
| Oxidized developer scavenger S-2 | 0.001 |
| HBS-2 | 0.317 |
| HBS-3 | 0.005 |
| TAI | 0.013 |
| Gelatin | 1.580 |

Layer 12: Ultraviolet Filter Layer

| | |
|---|---|
| Dye UV-1 | 0.108 |
| Dye UV-2 | 0.108 |
| Unsensitized silver bromide Lippmann emulsion | 0.215 |
| HBS-5 | 0.215 |
| Gelatin | 0.699 |

Layer 13: Protective Overcoat Layer

| | |
|---|---|
| Polymethylmethacrylate matte beads | 0.005 |
| Soluble polymethylmethacrylate matte beads | 0.054 |
| Silica gel particles | 0.108 |
| Silicone lubricant | 0.039 |
| Gelatin | 0.888 |

This film was hardened at coating with 1.75% by weight of total gelatin of hardener H-2. Surfactants, coating aids, soluble absorber dyes, antifoggants, stabilizers, antistatic agents, biocides, and other addenda chemicals were added to the various layers of this sample as is commonly practiced in the art.

Sample 202 (invention)

A color photographic recording material for color negative development was prepared exactly as in Sample 201 above, except where noted below. The cyan dye-forming coupler C-1 employed in the high sensitivity red-sensitive layer was dispersed in the general manner of the inventive example C in dispersion Example 1, without the presence of high boiling solvent HBS-2.

Layer 4: High Sensitivity Red-Sensitive Layer Changes

| | |
|---|---|
| HBS-2 | 0.000 |

Sample 203 (invention)

A color photographic recording material for color negative development was prepared exactly as in Sample 201, except where noted below. The cyan dye-forming coupler C-1 employed in the high sensitivity red-sensitive layer was dispersed in the general manner of the inventive example C in dispersion Example 1, without the presence of a high boiling solvent. A separate dispersion of HBS-2 was added to the liquid coating solution to provide an equal coverage by weight to that of cyan dye-forming coupler C-1.

Sample 204 (invention)

A color photographic recording material for color negative development was prepared exactly as Sample 202, except where noted below. The red-sensitized tabular silver iodobromide emulsion of Layer 4 comprised 3.1 mol % iodide, with an average grain diameter 2.42 micrometers and thickness 0.12 micrometers. This emulsion comprised 1.0 mol % lower iodide than the emulsion employed in Sample 202. The lower iodide emulsion was prepared as described in U.S. Pat. No. 5,164,292.

Sample 205 (invention)

A color photographic recording material for color negative development was prepared exactly as Sample 202, except where noted below. The red-sensitized tabular silver iodobromide emulsion of Layer 4 comprised 2.0 mol % iodide, with an average grain diameter 3.07 micrometers and thickness 0.12 micrometers. This emulsion comprised 2.1 mol % lower iodide than the emulsion employed in Sample 202. The lower iodide emulsion was prepared as described in U.S. Pat. No. 5,164,292.

Sample 206 (invention)

A color photographic recording material for color negative development was prepared exactly as Sample 202, except where noted below. DIR coupler D-5 was not included in Layer 4.

Layer 4: High Sensitivity Red-Sensitive Layer Changes

| | |
|---|---|
| DIR coupler D-5 | 0.000 |
| HBS-4 | 0.000 |

Sample 207 (invention)

A color photographic recording material for color negative development was prepared exactly as Sample 202, except where noted below. Layer 4 additionally comprised bleach accelerator releasing compound BAR-1.

Layer 4: High Sensitivity Red-Sensitive Layer Changes

| | |
|---|---|
| Bleach accelerator coupler BAR-1 | 0.011 |
| HBS-2 | 0.000 |
| HBS-3 | 0.011 |

Sample 208 (invention)

A color photographic recording material for color negative development was prepared exactly as Sample 207 above, except Layer 4 comprised bleach accelerator releasing compound BAR-1 in a higher amount.

Layer 4: High Sensitivity Red-Sensitive Layer Changes

| | |
|---|---|
| Bleach accelerator coupler BAR-1 | 0.027 |
| HBS-2 | 0.000 |
| HBS-3 | 0.027 |

Sample 209 (invention)

A color photographic recording material for color negative development was prepared exactly as Sample 202, except where noted below. Layer 4 additionally comprised a development accelerating compound, CHEM-1.

Layer 4: High Sensitivity Red-Sensitive Layer Changes

| | |
|---|---|
| Development accelerator compound CHEM-1 | 0.007 |
| HBS-2 | 0.000 |

Samples 201–209 were individually exposed for 1/500 of a second to white light from a tungsten light source of 3200 K color temperature that was filtered by a Daylight Va filter to 5500 K through a graduated 0–4.0 density step tablet to determine their speed and gamma. The samples were then processed using a color negative process, the Kodak C-41 process, as described by the 1988 Annual of the British Journal of Photography, pages 196–198. Another description of the use of the C-41 Flexicolor Process can be found in "Using Kodak Flexicolor Chemicals", Publication Z-131, Eastman Kodak Company, Rochester, N.Y. (Kodak is a trademark of the Eastman Kodak Company, U.S.A.).

Following processing and drying, Samples 201–209 were subjected to Status M densitometry. The photographic performance of the recording materials is compared below in Table VI.

TABLE VI

| | Red-Light Sensitive Unit Performance | | | | | |
|---|---|---|---|---|---|---|
| | | | Gamma | | Gradient | Density at |
| Sample | D-min | IR Speed | Low | Low-mid | Meter GAMMA | .50 log H |
| 201 (comparison) | 0.294 | 348 | 0.556 | 0.623 | 0.612 | 2.27 |
| 202 (invention) | 0.296 | 344 | 0.555 | 0.604 | 0.593 | 2.21 |
| 203 (invention) | 0.291 | 347 | 0.563 | 0.614 | 0.613 | 2.27 |
| 204 (invention) | 0.308 | 343 | 0.557 | 0.637 | 0.635 | 2.27 |
| 205 (invention) | 0.283 | 347 | 0.570 | 0.626 | 0.625 | 2.26 |
| 206 (invention) | 0.296 | 346 | 0.633 | 0.660 | 0.640 | 2.32 |
| 207 (invention) | 0.297 | 347 | 0.591 | 0.630 | 0.615 | 2.25 |
| 208 (invention) | 0.305 | 346 | 0.619 | 0.650 | 0.655 | 2.29 |
| 209 (invention) | 0.308 | 347 | 0.535 | 0.571 | 0.570 | 2.19 |

The photographic data for Sample 202 show that the inventive high boiling solvent-free dispersion of cyan dye-forming coupler C-1 can provide nearly identical sensitometric performance following direct substitution for the comparative control dispersion employing di-n-butylphthalate in a weight ratio 1.0 to C-1 in the high sensitivity red-sensitive layer of color negative recording material of Example 2. The photographic data for Sample 203 show that the inventive high boiling solvent-free, improved stability dispersion of cyan dye-forming coupler C-1 can be combined with a dispersion of HBS-2 in a weight ratio of 1.0 during the preparation of the liquid coating solution to provide identical sensitometric response. The photographic data for Samples 204–205 show that the inventive high boiling solvent-free dispersion of cyan dye-forming coupler C-1 can be combined with silver halide grains that comprise lower iodide content to preserve sensitivity and increase the gamma response of the photographic unit, while the coverage of high boiling solvent is reduced affording thinner layers. The photographic data for Sample 206 show that the gamma and density response of the photographic unit comprising the inventive high boiling solvent-free dispersion of cyan dye-forming coupler C-1 can be increased by a reduction in the level of development inhibiting releasing coupler employed in the layer. The photographic data for Samples 207 and 208 show that the inventive high boiling solvent-free dispersion of cyan dye-forming coupler C-1 can be combined with bleach accelerating releasing compound which provides increased layer developability and increases the gamma and maximum density of the red light sensitive unit. The photographic data for Sample 209 show that the inventive high boiling solvent-free dispersion of cyan dye-forming coupler C-1 can be employed with a development accelerating polymeric chemical to provide improved speed.

PHOTOGRAPHIC EXAMPLE 9

Sample 301 (comparative control)

A color photographic recording material for color negative development identical to Photographic Sample 201 was prepared. This film was hardened at coating with 1.75% by weight of total gelatin of hardener H-2. Surfactants, coating aids, soluble absorber dyes and stabilizers were added to the various layers of this sample as is commonly practiced in the art.

Sample 302 (invention)

A color photographic recording material for color negative development was prepared exactly as for Sample 301 above, except where noted below. The cyan dye-forming coupler C-1 employed in the high sensitivity red-sensitive layer (Layer 4) and the medium sensitivity red-sensitive layer (Layer 3) was dispersed in the general manner of the inventive example C in dispersion Example 1, without the presence of a high boiling solvent.

Layer 3: Medium Sensitivity Red-Sensitive Layer Changes

| | |
|---|---|
| HBS-2 | 0.000 |

Layer 4: High Sensitivity Red-Sensitive Layer Changes

| | |
|---|---|
| HBS-2 | 0.000 |

Sample 303 (invention)

A color photographic recording material for color negative development was prepared exactly as Sample 301, except where noted below. The cyan dye-forming coupler C-1 employed in the high sensitivity red-sensitive layer (Layer 4) and the medium sensitivity red-sensitive layer (Layer 3) was dispersed in the general manner of the inventive example C in dispersion Example 1, without the presence of a high boiling solvent. A separate dispersion of HBS-2 was added to the liquid coating solutions of both layers to provide an equal coverage by weight to that of cyan dye-forming coupler C-1.

Sample 304 (invention)

A color photographic recording material for color negative development was prepared exactly as Sample 301, except where noted below. The cyan dye-forming coupler C-1 employed in the high sensitivity red-sensitive layer (Layer 4), the medium sensitivity red-sensitive layer (Layer 3), and the low sensitivity red-sensitive layer (Layer 2) was dispersed in the general manner of the inventive example C in dispersion Example 1, without the presence of a high boiling solvent. A separate dispersion of HBS-2 was added to the liquid coating solutions of all three layers to provide an equal coverage by weight to that of cyan dye-forming coupler C-1.

Sample 305 (invention)

A color photographic recording material for color negative development was prepared exactly as Sample 301, except where noted below. The cyan dye-forming coupler C-1 employed in the high sensitivity red-sensitive layer (Layer 4) and the medium sensitivity red-sensitive layer (Layer 3) was dispersed in the general manner of the inventive example C in dispersion Example 1, without the presence of a high boiling solvent. The coverages of coupler C-1 were increased significantly.

Layer 3: Medium Sensitivity Red-Sensitive Layer Changes

| | |
|---|---|
| Cyan dye-forming coupler C-1 | 0.312 |
| HBS-2 | 0.000 |

Layer 4: High Sensitivity Red-Sensitive Layer Changes

| | |
|---|---|
| Cyan dye-forming coupler C-1 | 0.183 |
| HBS-2 | 0.000 |

Sample 306 (invention)

A color photographic recording material for color negative development was prepared exactly as Sample 305, except where noted below. The development inhibitor releasing coupler D-5 in Layers 3 and 4 was replaced with D-9 in equimolar amounts. D-5 had been dispersed with HBS-4, however, while D-9 was dispersed with HBS-2. Accordingly, the coverage amounts for these solvents was also changed, but the overall solvent level was maintained relative to Sample 305. The photographically useful group of D-9 comprising switch and inhibitor moieties released by the parent coupler has a higher tendancy to migrate out of the originating layer before releasing the inhibitor fragment relative to the photographically useful group of D-5, which in turn causes development retardation.

Layer 3: Medium Sensitivity Red-Sensitive Layer Changes

| | |
|---|---|
| Cyan dye-forming coupler C-1 | 0.312 |
| DIR coupler D-5 | 0.000 |
| DIR coupler D-9 | 0.011 |
| HBS-2 | 0.022 |
| HBS-4 | 0.000 |

Layer 4: High Sensitivity Red-Sensitive Layer Changes

| | |
|---|---|
| Cyan dye-forming coupler C-1 | 0.183 |
| DIR coupler D-5 | 0.000 |
| DIR coupler D-9 | 0.020 |
| HBS-2 | 0.041 |
| HBS-4 | 0.000 |

Samples of photographic recording materials Samples 301–306 were individually exposed for 1/500 of a second to white light from a tungsten light source of 3200 K color temperature that was filtered by a Daylight Va filter to 5500 K through a graduated 0–4.0 density step tablet to determine their speed and gamma. The samples were then processed using the Kodak C-41 process.

Following processing and drying, Samples 301–306 were subjected to Status M densitometry. The photographic performance of the recording materials is compared below in Table VII.

TABLE VII

| | Red-Light Sensitive Unit Performance | | | | | |
|---|---|---|---|---|---|---|
| | | | Gamma | | Gradient | Density at |
| Sample | D-min | IR Speed | Low | Low-mid | Meter GAMMA | .50 log H |
| 301 (comparison) | 0.286 | 342 | 0.552 | 0.623 | 0.630 | 2.26 |
| 302 (invention) | 0.294 | 340 | 0.473 | 0.484 | 0.505 | 1.96 |
| 303 (invention) | 0.300 | 341 | 0.497 | 0.580 | 0.610 | 2.19 |
| 304 (invention) | 0.290 | 342 | 0.501 | 0.586 | 0.618 | 2.20 |
| 305 (invention) | 0.298 | 341 | 0.488 | 0.507 | 0.520 | 2.01 |
| 306 (invention) | 0.293 | 343 | 0.504 | 0.545 | 0.570 | 2.10 |

The photographic data for Sample 302 show that the inventive high boiling solvent-free dispersion of cyan dye-forming coupler C-1 provides reduced gamma and density formation performance following direct substitution for the comparative control dispersion employing di-n-butylphthalate in a weight ratio 1.0 to C-1 in the high and medium sensitivity red-sensitive layers of color negative recording material of Example 3. The photographic data for Sample 303 show that the inventive high boiling solvent-free, improved stability dispersion of cyan dye-forming coupler C-1 can be combined with a dispersion of HBS-2 in a weight ratio of 1.0 during the preparation of the liquid coating solution for both layers to provide nearly identical sensitometric response. The photographic data for Sample 304 show that the inventive high boiling solvent-free, improved stability dispersion of cyan dye-forming coupler C-1 can be combined with a dispersion of HBS-2 in a weight ratio of 1.0 during the preparation of the liquid coating solution for all three red-sensitive layers comprising coupler C-1 to provide identical nearly sensitometric response. The photographic data for Sample 305 show that the inventive high boiling solvent-free dispersion of cyan dye-forming coupler C-1 can be employed in higher laydowns in the absence of HBS-2 to improve the gamma response of the photographic unit, while the coverage of high boiling solvent is reduced affording thinner layers. The photographic data for Sample 306 show that the gamma and density response of the photographic unit comprising the inventive high boiling solvent-free dispersion of cyan dye-forming coupler C-1 can be increased by changing the properties of development inhibiting releasing coupler employed in the layer to select a compound that has higher interlayer than intralayer inhibition.

tricresylphosphate HBS-1 di-n-butylphthalate HBS-2

N,N-diethyllauramide HBS-3

N-n-butylacetanilide HBS-4

1,4-cyclohexylenedimethylenebis(2-ethylhexanoate) HBS-5

D-1

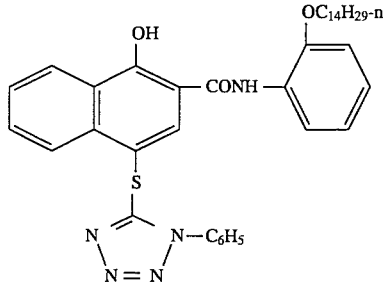

D-2

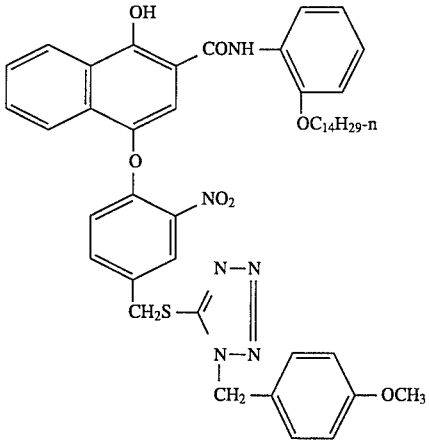

-continued
D-3
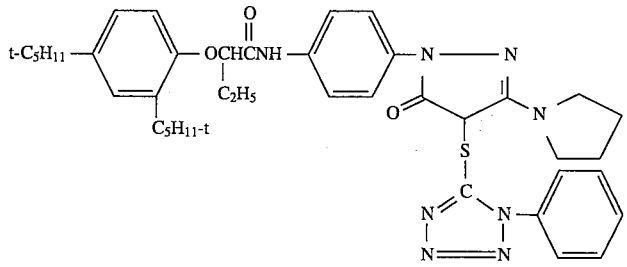
D-4
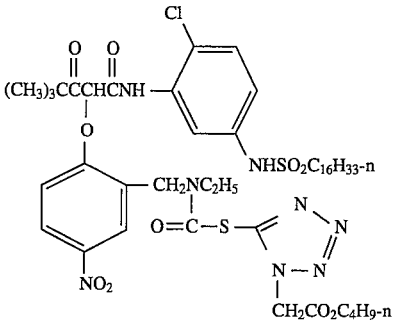
D-5
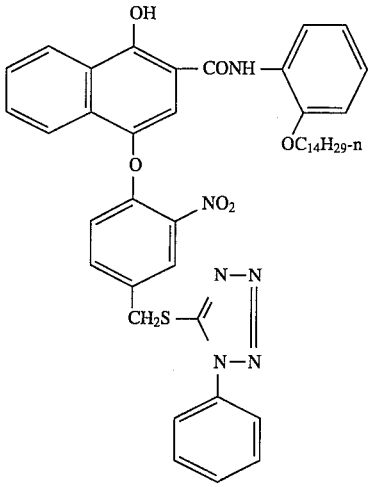
D-6
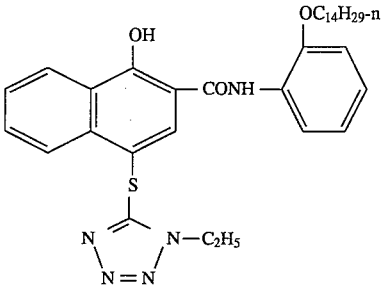
D-7
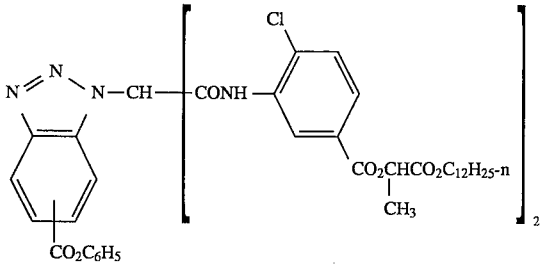
D-8
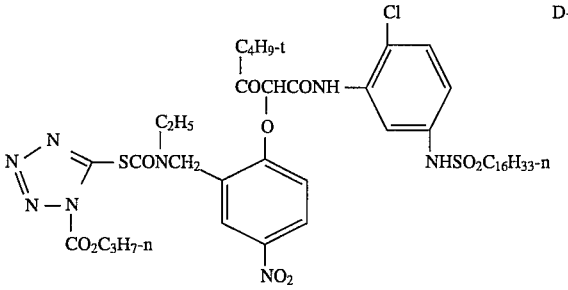
D-9
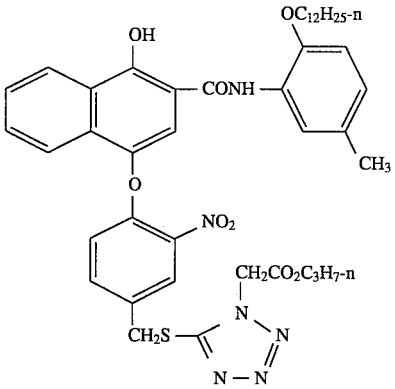

-continued
D-10
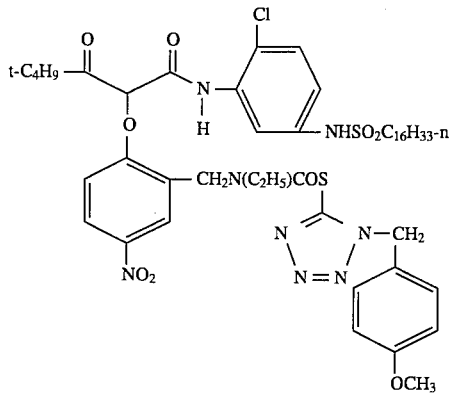
CM-1
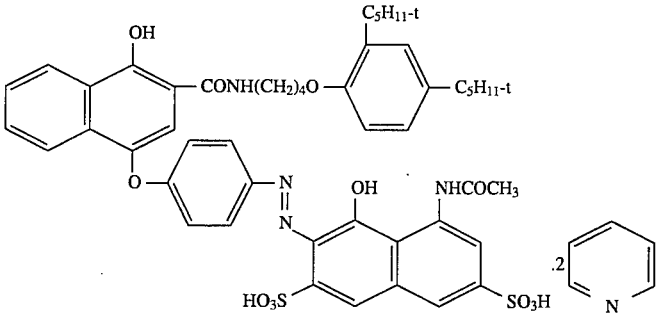
M-1
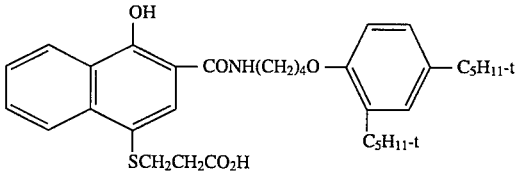
BAR-1
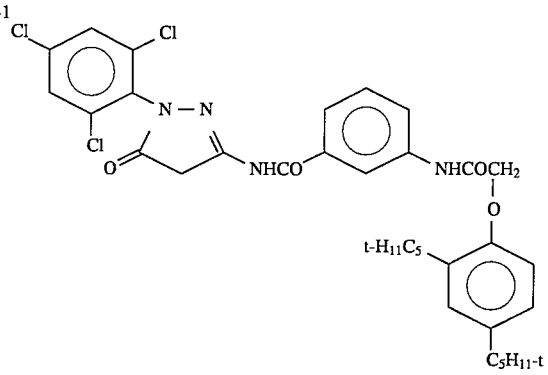
M-2
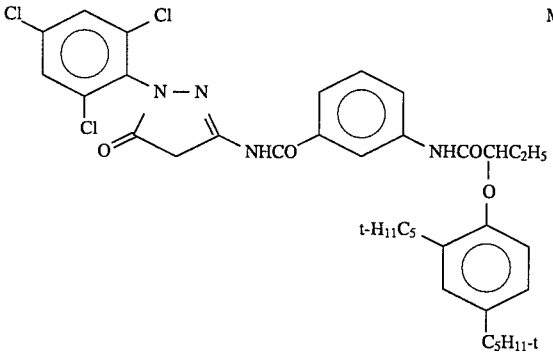
M-3
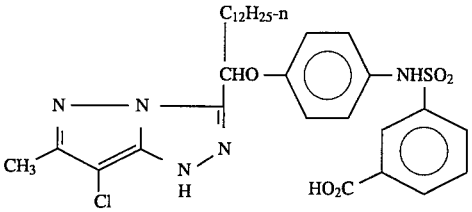

-continued
M-4
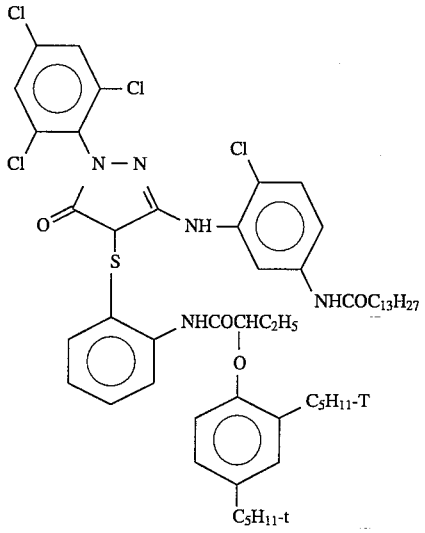
MM-1
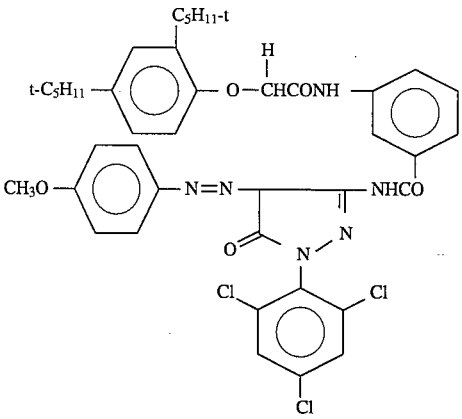
MM-2
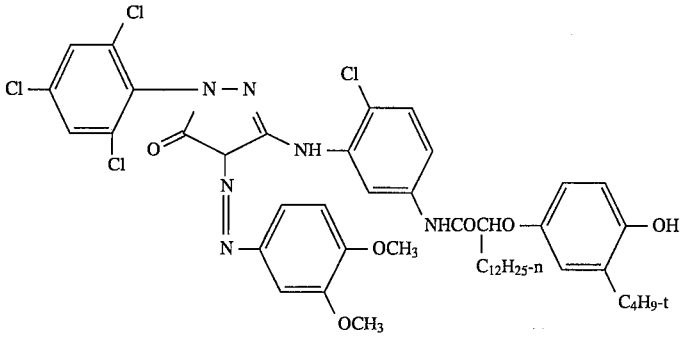
Y-1
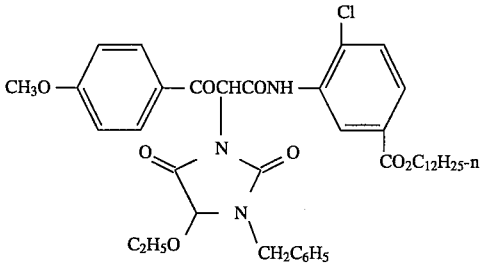
Y-2
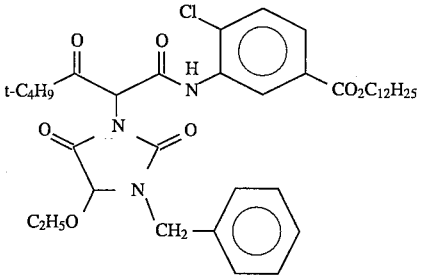
YD-1
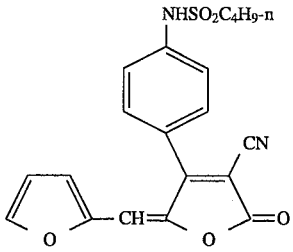
UV-1
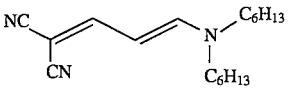

-continued
UV-2
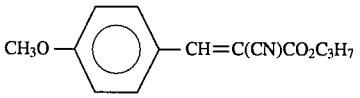
CD-1
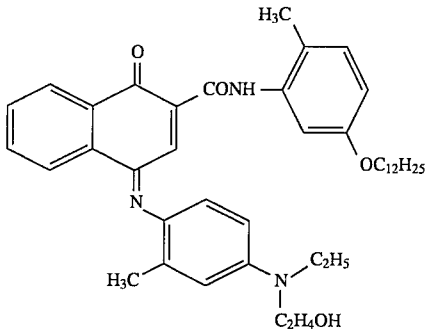
MD-1
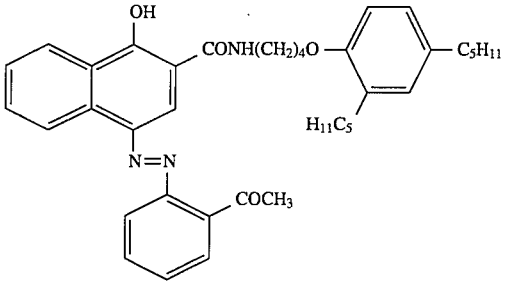
MD-2
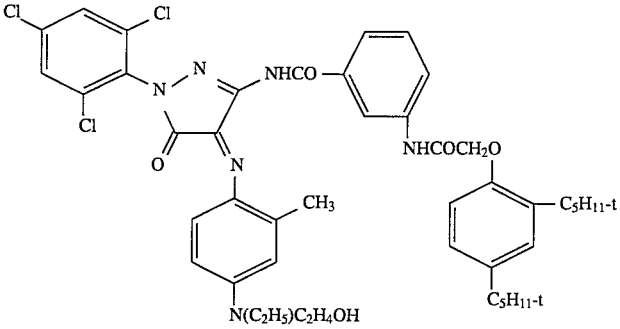
YD-2
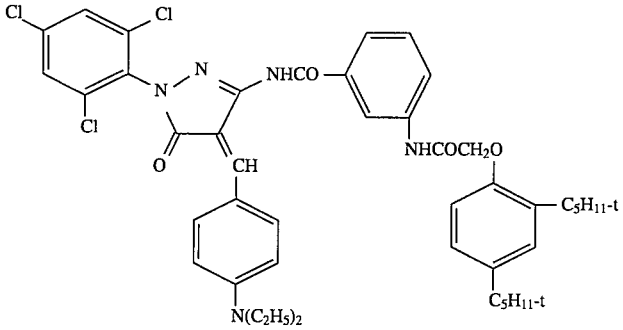
S-1
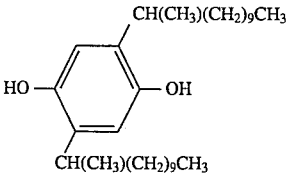
S-2
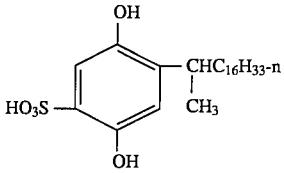
S-3
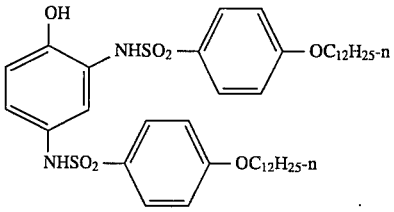
H-1
bis(vinylsulfonyl) methyl ether -continued

| | | | |
|---|---|---|---|
| bis(vinylsulfonyl) methane | H-2 | Poly(2,2'-thiodiethylene glutarate) | CHEM-1 |
| 4-hydroxy-6-methyl-1,3,3a,7-tetraazaindene | | | TAI |

This invention has been described in detail with particular reference to preferred embodiments thereof. It will be understood that variations and modifications can be made within the spirit and scope of the invention.

What is claimed is:

1. A method of providing a silver halide color photographic light sensitive material comprising:

a) dissolving a phenolic cyan coupler of Formula I in an auxiliary solvent, dispersing the auxiliary solvent and dissolved coupler in an aqueous gelatin solution to form a dispersed phase consisting essentially of coupler and auxiliary solvent substantially free of permanent organic solvent, and removing the auxiliary solvent from the resulting dispersion;

b) preparing an aqueous coating solution comprising the dispersion resulting from a); and c) coating the solution resulting from b) on a photographic support;

Formula I

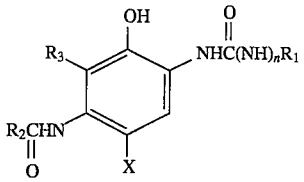

wherein $R_1$ and $R_2$ each represent an aliphatic group, an aromatic group, or a heterocyclic group, $R_3$ represents a hydrogen atom, a halogen atom, an aliphatic group, an acylamino group, or a non-metallic atomic group necessary to form a nitrogen-containing 5-membered or 6-membered ring together with $R_2$, X represents a hydrogen atom or a group capable of being released upon a coupling reaction with oxidation product of a developing agent, and n represents 1.

2. A method according to claim 1, wherein the aliphatic group represented by $R_1$ or $R_2$ is an aliphatic group having from 1 to 32 carbon atoms.

3. A method according to claim 1, wherein a $R_1$ or $R_2$ group is substituted with an alkyl group, an aryl group, a heterocyclic group, an alkoxy group, an aryloxy group, an alkenyloxy group, an acyl group, an ester group, an amido group, a carbamoyl group, a sulfamoyl group, an imido group, a ureido group, an aliphatic or aromatic sulfonyl group, an aliphatic or aromatic thio group, a hydroxy group, a cyano group, a carboxy group, a nitro group, a sulfo group, or a halogen atom.

4. A method according to claim 1, wherein X is a hydrogen atom, a halogen atom, an alkoxy group, an aryloxy group, an acyloxy group, a sulfonyloxy group, an amido group, an alkoxycarbonyloxy group, an aryloxycarbonyloxy group, an aliphatic or aromatic thio group, an imido group, a sulfonamido group, or an aromatic azo group.

5. A method according to claim 1, wherein $R_1$ is an aryl group or a heterocyclic group.

6. A method according to claim 5, wherein $R_1$ is an aryl group substituted with one or more halogen atom, alkyl group, alkoxy group, aryloxy group, acylamino group, acyl group, carbamoyl group, sulfamido group, oxycarbonyl group or cyano group substituents.

7. A method according to claim 5, wherein $R_1$ is an aryl group substituted with one or more halogen atom or cyano group substituents.

8. A method according to claim 1, wherein $R_2$ is an alkyl group or an aryl group.

9. A method according to claim 1, wherein $R_2$ is an alkyl group substituted with an aryloxy group.

10. A method according to claim 1, wherein X represents a hydrogen atom, a halogen atom, an alkoxy group, an aryloxy group, an acyloxy group or a sulfonamido group.

11. A method according to claim 10, wherein X is a hydrogen atom.

12. A method according to claim 1, wherein n is 1 and X is a hydrogen atom, a halogen atom, or a aryloxy group.

13. A method according to claim 1, wherein the cyan coupler dispersion particles have an average particle size of from 0.02 μm to 2 μm.

14. A method according to claim 1, wherein the auxiliary solvent is a low boiling organic solvent and is removed by evaporation.

15. A method according to claim 1, wherein the auxiliary solvent is a partially water soluble organic solvent and is removed by washing or membrane dialysis.

16. A method according to claim 1, wherein the dispersion comprises a single cyan coupler of Formula I substantially free of other cyan dye forming couplers.

17. A method according to claim 16, wherein the cyan coupler is of the following structure:

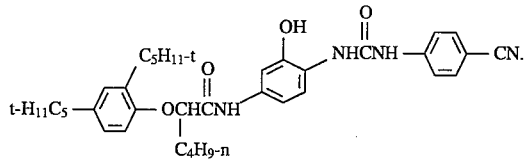

18. A method according to claim 1, wherein the cyan coupler is of the following structure

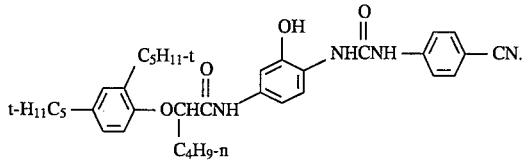

* * * * *